United States Patent [19]

Kiuchi et al.

[11] Patent Number: 4,770,140

[45] Date of Patent: Sep. 13, 1988

[54] METHOD AND APPARATUS FOR CONTROLLING THE SOLENOID CURRENT OF A SOLENOID VALVE WHICH CONTROLS THE AMOUNT OF SUCTION OF AIR IN AN INTERNAL COMBUSTION ENGINE

[75] Inventors: Takeo Kiuchi; Akimasa Yasuoka, both of Wako, Japan

[73] Assignee: Honda Giken Kogyo Kabushiki Kaisha, Tokyo, Japan

[21] Appl. No.: 920,543

[22] Filed: Oct. 20, 1986

[30] Foreign Application Priority Data

Oct. 21, 1985 [JP] Japan ..... 60-233351
Oct. 21, 1985 [JP] Japan ..... 60-233364

[51] Int. Cl.[4] ..... F02D 41/16
[52] U.S. Cl. ..... 123/339
[58] Field of Search ..... 123/339, 352, 361, 585, 123/353, 354, 438, 571, 490, 357; 361/140

[56] References Cited

U.S. PATENT DOCUMENTS

| | | | |
|---|---|---|---|
| 4,134,373 | 1/1979 | Kibler et al. | 123/352 |
| 4,378,766 | 4/1983 | Yamazoe et al. | 123/339 |
| 4,446,410 | 5/1984 | Yagura et al. | 318/687 |
| 4,491,113 | 1/1985 | Gassler et al. | 123/490 |
| 4,526,144 | 7/1985 | Hasegawa et al. | 123/585 |

FOREIGN PATENT DOCUMENTS

| | | | |
|---|---|---|---|
| 59-176447 | 10/1984 | Japan | 123/339 |
| 59-221444 | 12/1984 | Japan | 123/339 |
| 2102600 | 2/1983 | United Kingdom . | |

OTHER PUBLICATIONS

Patent Abstracts of Japan, vol. 9, No. 80, (M-370) [1803], Apr. 10, 1985, (JP-A-59-211741).

*Primary Examiner*—Andrew M. Dolinar
*Attorney, Agent, or Firm*—Armstrong, Nikaido, Marmelstein & Kubovcik

[57] ABSTRACT

A method and apparatus are provided for controlling the solenoid current of a solenoid valve which controls the amount of suction air in an internal combustion engine. An actual current flowing through the solenoid is detected and a solenoid current control value is calculated as a function of engine operating conditions. A corrected solenoid current control value is determined as a function of the solenoid current control value and a feedback control term is calculated as a function of the difference between the corrected solenoid current control value and the actual solenoid current. An initial value for the feedback control term is determined as a function of an integration term which forms part of the feedback control term. A pulse duration signal is determined as a function of the corrected solenoid current value and an output pulse duration signal is calculated as a function of the pulse duration signal and the feedback control term. In another aspect, a predetermined current control value is used as the corrected solenoid current control value when the engine speed is above a predetermined value. In still a further aspect, the output pulse duration is corrected as a function of battery voltage.

4 Claims, 10 Drawing Sheets

METHOD AND APPARATUS FOR CONTROLLING THE SOLENOID CURRENT OF A SOLENOID VALVE WHICH CONTROLS THE AMOUNT OF SUCTION OF AIR IN AN INTERNAL COMBUSTION ENGINE

BACKGROUND OF THE INVENTION

This invention relates to a method and apparatus for controlling the solenoid current of a solenoid valve which controls the amount of suction air in an internal combustion engine, and more particularly, to a method and apparatus for controlling the solenoid current of a solenoid valve which controls the amount of suction air in an internal combustion engine wherein the solenoid current is controlled for proportionally controlling the opening of a solenoid valve connected in a by-pass path which couples the upstream and downstream sides of a throttle valve provided in a suction air path.

Referring to FIG. 11, it has been previously proposed that in idling of an internal combustion engine 10, the engine continues to run while a throttle valve 11, provided in a suction air path of the engine, is held in a substantially closed condition. The amount of suction air of the internal combustion engine is controlled by a solenoid valve 12 provided in a by-pass path 13 between the upstream and downstream side of the throttle valve in order to control the rotational speed of the engine (idling rotating speed). Such an idling rotational speed controlling method is disclosed in detail, for example, in Japanese Patent Application No. 60-137445.

The idling rotational speed controlling method in Japanese Patent Application No. 60-137445 includes a step of first calculating a solenoid current control value Icmd by an equation (1), given below, in a central processor (CPU) 1 of a microprocessor 4 which further includes, as shown in FIG. 2, a storage unit or memory 2 and an input/output signal converting circuit or interface 3.

In order to calculate Icmd in the CPU 1, the interface 3 must be supplied with signals from various sensors suitably located in the engine (not shown). This is well known in the art.

$$Icmd=[Ifb(n)+Ie+Ips+Iat+Iac]\times Kpad \quad (1)$$

In equation (1), Ifb(n) is a feedback control term which is calculated in accordance with the flow chart of FIG. 3 which will be hereinafter described. Here, (n) indicates the present time value. The calculations of steps S41 to S46 of FIG. 3 are described as follows:

Step S41 . . . the value Me(n), which is the reciprocal of the engine rotational speed, is read.

Step S42 . . . a deviation ΔMef is calculated which is the difference between Me(n) thus read and Mrefo which is a reciprocal of a preset aimed idling rotational speed Nrefo.

Step S43 . . . a difference between Me(n) and a preceding time measured value Me for the same cylinder as Me(n) in the case of a six cylinder engine, Me(n−6), that is, a coefficient of variation ΔMe of the period, is calculated.

Step S44 . . . an integration term Ii, a proportion term Ip, and a differentiation term Id are calculated in accordance with respective equations indicated in the block of FIG. 3 for the Step S44 using ΔMe and ΔMef calculated above as well as an integration term control gain Kim, a proportion term control gain Kpm, and a differentiation term control gain Kdm. The control gains are obtained by recalling them from the memory 2 where they were stored in advance.

Step S45 . . . the integration term Ii obtained in the preceding Step S44 is added to Iai(n−1) to obtain Iai(n). Iai(n) obtained here is temporarily stored in the memory 2 so that this may be Iai(n−1) for the next cycle. However, when there is no value stored in the memory 2, some initial value of Iai may be stored in the memory 2 in advance to be read out therefrom as Iai(n−i).

Step S46 . . . Ip and Id calculated at Step S44 are added to Iai(n) calculated at Step S45 to obtain Ifb(n) which is defined as a feedback control term.

The terms in equation (1) other than Ifb(n) are defined as follows:

Ie . . . an addition correction term for adding a predetermined value in accordance with a load of an AC generator (ACG), that is, the field current of the ACG.

Ips . . . an addition correction term for adding a predetermined value when a pressure switch in a power steering hydraulic circuit is turned on.

Iat . . . an addition correction term for adding a predetermined value when the selector position of an automatic transmission AT is in the drive (D) range.

Iac . . . an addition correction term for adding a predetermined value when an air conditioner is operative.

Kpad . . . a multiplication correction term determined in accordance with the atmospheric pressure.

Icmd in equation (1) is calculated in response to TDC pulses produced by a known means when the piston of each cylinder is at an angle of 90° before its top dead center.

Icmd calculated by equation (1) is further converted in the CPU 1, for example, into a duty ratio of pulse signals having a fixed period. The CPU 1 contains a periodic timer and a pulse signal high level time (pulse duration) timer which operates in a synchronized relationship so that pulse signals having a predetermined high level time or duration, are successively developed from the microprocessor 4 for each predetermined period. The pulse signals are applied to the base of a solenoid driving transistor 5. Consequently, the transistor 5 is driven to be turned on and off in response to the pulse signals.

Referring to FIG. 2, in response to the on state of the solenoid driving transistor 5, an electric current from battery 6 flows through a solenoid 7 and the transistor 5 to ground. Accordingly, the opening of a solenoid valve is controlled in accordance with the solenoid current, and an amount of suction air corresponding to the opening of the solenoid valve is supplied to the internal combustion engine to control the idling rotational speed.

Conventionally in a feedback control mode of the engine rotational speed, a determined value Ixref(n) is calculated by equation (2), below, and stored into the memory 2.

$$Ixref(n)=Iai(n)\times Ccrr/m+Ixref(n-1)\times(m-Ccrr)/m \quad (2)$$

Iai(n) in equation (2) is a value calculated at Step S45 of FIG. 3 described above, and Ixref(n−1) indicates the value of the determined value Ixref for the preceding time period. Further, m and Ccrr are selected positive values, and m is selected greater than Ccrr.

The calculation of the value Ixref(n) is effected in response to a TDC pulse when predetermined requirements are met, such as, for example, a requirement that there is no external load such as an air conditioner, as is apparent from the above mentioned Japanese Patent Application No. 60-137445.

When the solenoid valve of the internal combustion engine turns from the feedback control mode to an open loop control mode which is effected during operation other than idling, a pulse signal is developed from the microprocessor 4 in response to Icmd which is equal to the determined value Ixref(n), and the current flowing through the solenoid 7 and hence the opening of the solenoid valve is held to a predetermined value corresponding to the determined value Ixref(n). This is because it is intended that the initial opening of the solenoid valve when the internal combustion engine switches from the open loop control mode back to the feedback control mode may approach as near as possible to the opening corresponding to Icmd in the feedback control mode so that the time before a stabilized normal control condition is reached may be shortened.

Icmd in the open loop control mode is calculated by the following equation (3), similar to equation (1) above, so that pulse signals corresponding to the Icmd thus calculated may be developed from the microprocessor 4.

$$Icmd=(Ixref+Ie+Ips+Iat+Iac)\times Kpad \quad (3)$$

If Icmd is calculated in this manner and the solenoid current is determined in accordance with pulse signals corresponding to Icmd when the internal combustion engine switches from the open loop control mode back to the feedback control mode, the initial opening is reached in which an external load such as, for example, an air conditioner, is taken into consideration. This is desirable because the time required before an opening corresponding to Icmd for the feedback control mode is reached is further shortened.

The techniques described above, however, have the following drawbacks:

The resistance component of the solenoid 7 changes in response to a change in the temperature as is well known in the art. Because the solenoid valve having the solenoid 7 is commonly located near an engine body, it is readily influenced by the temperature of the engine. Accordingly, the resistance component of the solenoid 7 is readily changed.

If the resistance component of the solenoid 7 changes, a solenoid current corresponding to Icmd will not flow, and as a result, the opening of the solenoid valve which is expected by Icmd will not be attained. However, during feedback control, if a predetermined time elapses with feedback control of the engine rotational speed in accordance with FIG. 3 and equation (1), coincidence with an aimed idling rotation speed will be reached. However, the PID coefficient (control gain) of the feedback control term Ifb(n) is normally set to a small value with the stability during normal idling being taken into consideration. Accordingly, feedback control based on Ifb(n) is normally done slowly. Consequently, the techniques have a drawback in that when the resistance component of the solenoid 7 changes, a long period of time is required until the engine rotational speed reaches the aimed idling rotational speed after the feedback control has been started.

Further, the techniques have another drawback in that when there is a difference in temperature around the solenoid 7 between a point in time when the determined value Ixref is calculated, during feedback control, and another point in time when the determined value Ixref is used as an initial value for feedback control, or when the temperature around the solenoid 7 exhibits a change while the opening of the solenoid valve is under open loop control, the resistance of the solenoid 7 will change and thus, a desired opening of the solenoid valve, that is, the opening which is expected by Icmd, will not be reached.

A means which resolves such drawbacks as described above has been proposed by the present applicant (Japanese Patent Application No. P60-233355) which includes, in addition to a conventional engine rotational speed feedback control system, a current feedback control system for feeding back an actual electric current flowing through a solenoid 7 whereby a solenoid current control value calculated in the engine rotational speed feedback control system is corrected with a correction value calculated by the current feedback control system in a manner described below, and a signal, determined depending upon the thus corrected solenoid current control value, is applied to a solenoid current controlling means to control the solenoid current.

The corrected value is obtained by detecting an actual solenoid current, calculating a deviation of the actual solenoid current from the solenoid current control value, multiplying the deviation by a proportional term control gain to calculate a proportional term while multiplying the deviation by an integration term control gain and adding a preceding time integration term to the thus multiplied deviation to calculate an integration term, and then adding the integration term to the proportion term.

To describe the foregoing method in summary, even if, for example, the resistance of the solenoid 7 changes such that a condition occurs in which a solenoid current does not correspond to a solenoid current control value, control of the current feedback control system will result in a solenoid current corresponding to the solenoid current control value.

In the technique described above, wherein a current feedback control system is provided in addition to an engine rotational speed feedback control system, there are the following disadvantages:

Calculation of an integration term for calculating a correction term as described above includes multiplying a deviation by an integration term control gain and adding a preceding time integration term to the thus multiplied deviation. In this situation, generally the preceding time integration term when starting of current feedback control is set to 0. This is because upon starting the current feedback control, that is, when an ignition switch is turned on to start an engine, there is no preceding time integration term or value calculated. However, if the preceding time integration value is set to 0 as described above, the correction value may be different because the integration term is determined only depending upon a deviation of an actual electric current from a solenoid current control value which deviation is multiplied by the integration term control gain. Accordingly, when the ignition switch is turned on, the solenoid current which is determined depending upon a sum of the solenoid current control value and the correction value is very low and will gradually increase or decrease to a value corresponding to the solenoid current control value, as described above.

The speed of such change is determined from control gains of the integration and proportion terms described above, and the control gains are normally set to a small value in order to provide stability in the change in the solenoid current.

As is apparent from the foregoing description, when a current feedback control system is provided in addition to an engine rotational speed feedback control system for controlling the solenoid current, there is the disadvantage that it takes a relatively long time after the starting of the engine, before the value reaches a value corresponding to a corrected solenoid current control value. Hence the engine rotation speed will not rapidly rise to a predetermined rotational speed corresponding to the solenoid current control value.

In addition, due to a fact that there is a variance in characteristics among solenoid valves, another disadvantage is that there is a variation in time before a solenoid current reaches a value corresponding to a corrected solenoid current control value. This will cause a variation in time before the engine rotational speed rises to a predetermined rotational speed corresponding to the solenoid current instruction value.

Further, as described hereinabove, the solenoid valve provided in the by-pass path is used mainly for engine rotational speed control during idling operation. Thus, when the engine rotational speed of a car is higher than a predetermined rotational speed (for example, 4000 RPM or more), it is presumed that the car is running at a speed higher than a predetermined level and the opening of the throttle valve is controlled by operation of an accelerator by a driver. Control of the solenoid valve is thus unnecessary, and hence the solenoid current is zero.

However, if the solenoid current is reduced to zero in a running condition as described above, no output signal is developed from the current feedback control system. Accordingly, if, for example, the coil temperature of the solenoid changes and consequently the characteristic (resistance) of the coil changes, when control of the solenoid valve is resumed, control of the solenoid valve will be initiated with an opening of the valve different from the opening which is actually required. Since the control gain in the engine rotational speed feedback control system is normally set to a low value as described hereinabove, if control of the solenoid valve is initiated with an opening of the solenoid valve different from an actually required opening in this manner, a relatively long period of time will be required before the actual engine rotational speed reaches an aimed idling rotational speed.

Further, when the coil temperature changes as in a running condition as described above and then control of the solenoid valve is changed to the open loop control mode in accordance with the engine rotational speed, control will be initiated without an opening of the solenoid valve coincident with the required opening.

SUMMARY OF THE INVENTION

It is an object of the present invention to provide a method and apparatus for controlling the solenoid current of a solenoid valve which controls the amount of suction air in an internal combustion engine, which substantially eliminates the variation in time that it takes to reach a desired engine rotational speed as a result of variations in solenoid characteristics.

It is another object of the present invention to provide a method and apparatus for controlling solenoid current wherein a predetermined solenoid current control value is used to provide a solenoid current when the engine speed is above a predetermined value and ordinarily, the solenoid current would be zero.

It is still another object of the present invention to provide a method and apparatus for controlling the solenoid current wherein the solenoid current is corrected as a function of battery voltage.

The present invention is directed to a method and apparatus for controlling the solenoid current of a solenoid valve which controls the amount of suction air in an internal combustion engine. An actual current flowing through the solenoid is detected and a solenoid current control value is calculated as a function of engine operating conditions. A corrected solenoid current control value is determined as a function of the solenoid current control value and a feedback control term is calculated as a function of the difference between the corrected solenoid current control value and the actual solenoid current. An initial value for the feedback control term is determined as a function of an integration term which forms part of the feedback control term. A pulse duration signal is determined as a function of the corrected solenoid current value and an output pulse duration signal is calculated as a function of the pulse duration signal and the feedback control term.

In another aspect of the invention, a predetermined current control value is used as the corrected solenoid current control value when the engine speed is above a predetermined value.

In still a further aspect of the invention, the output pulse duration is corrected as a function of battery voltage.

DETAILED DESCRIPTION OF THE PREFERRED EMBODIMENT

Figure 2:
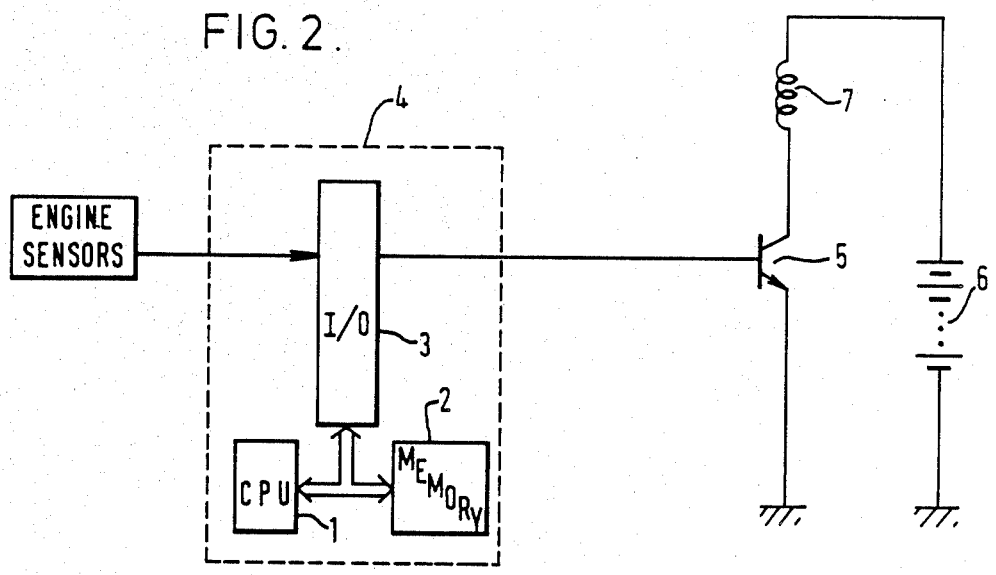
FIG. 2 is a circuit diagram showing a conventional solenoid current controlling device.
Figure 4:
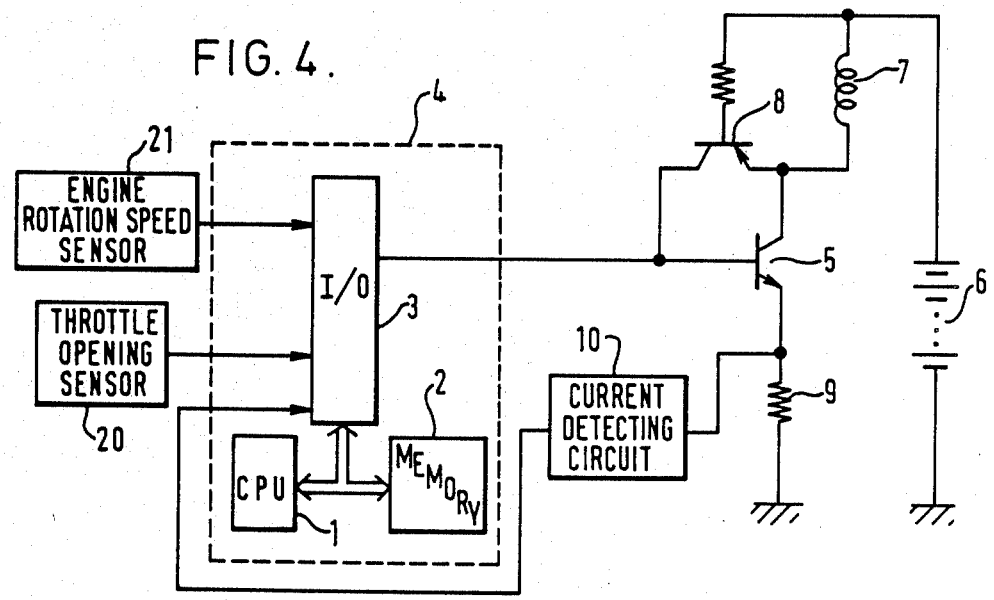
FIG. 4 is a circuit diagram showing an embodiment of solenoid current controlling device of the present invention.

FIG. 4 is a circuit diagram illustrating a solenoid current controlling device of the present invention. Referring to FIG. 4, like reference symbols denote the same or equivalent parts as those of FIG. 2.

When a pulse signal obtained in a manner hereinafter described, is output from a microprocessor 4, it is applied to the base of a solenoid driving transistor 5, and the transistor 5 is driven on or off in response to the pulse signal.

In FIG. 4, when the transistor 5 is on, current from a battery 6 flows through a solenoid 7, the transistor 5 and a resistor 9 to ground. Consequently, the opening of a solenoid valve (not shown) is controlled in response to the solenoid current. When the transistor 5 is interrupted in response to the falling edge of a pulse signal from the microprocessor 4, a back electromotive force is generated in the solenoid 7. Transistor 8 is rendered conductive in response to such a back electromotive force so that the transistor 5 is kept on while the back electromotive force continues to be produced. The entire current variation of the solenoid current may thus be detected as a voltage drop across the resistor 9.

A current detecting circuit 10 supplies the actual current value Iact through the solenoid 7 which is detected as a voltage drop across the resistor 9, to an interface 3. The interface 3 converts the output of the current detecting circuit 10, and accordingly, the actual current value Iact flowing through the solenoid 7, into a digital signal.

Now, the operation of generating a pulse signal which is an output of the microprocessor 4 to which the method of the present invention is applied will be described with reference to FIGS. 1A and 1B which are a flow chart illustrating the operation of the microprocessor 4 with which the present invention is used.

Figure 1A:
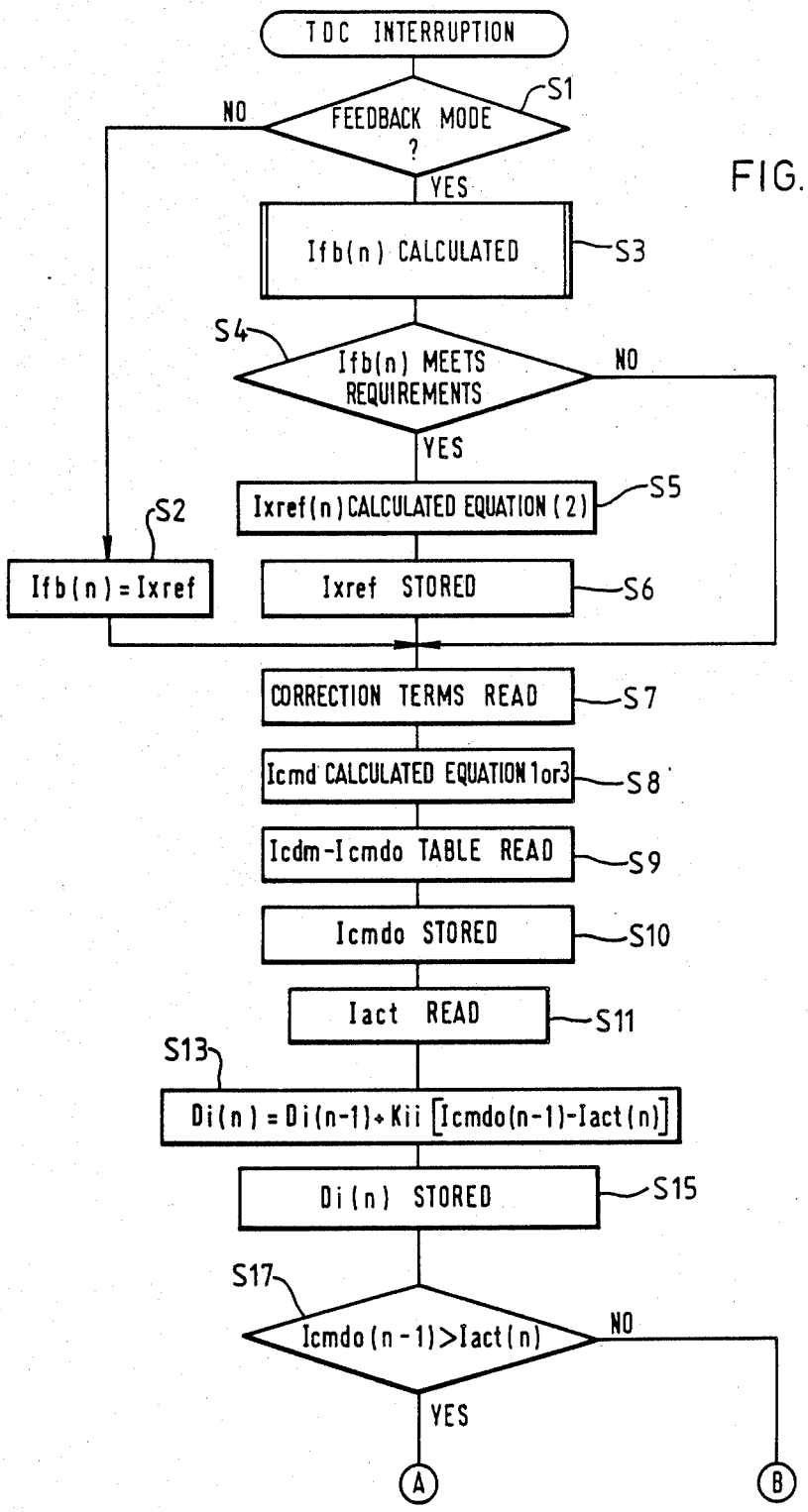
FIGS. 1A and 1B are a flow chart illustrating operation of a microprocessor to which an embodiment of the present invention is applied.
Figure 1B:
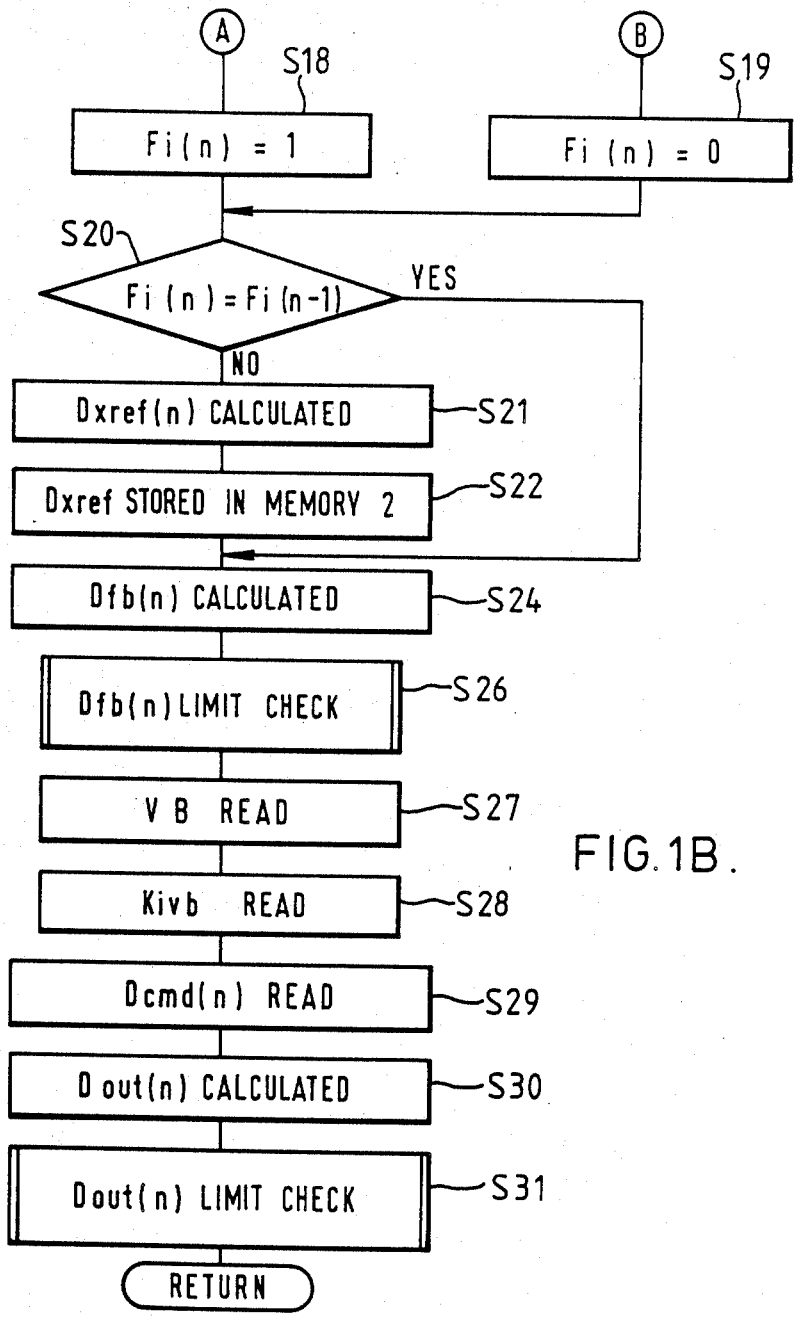

Operation of the flow chart of FIGS. 1A and 1B is started by interruption by TDC pulses.

Step S1 . . . it is determined whether or not the engine is in an engine rotational speed feedback control mode (feedback mode) which stabilizes idling rotational speed to control the solenoid valve, wherein, the opening of the solenoid valve is controlled in response to a solenoid current.

More particularly, when it is determined from a signal supplied from a throttle opening sensor 20 that a throttle valve is in a substantially fully closed condition and it is also determined from a signal supplied from an engine rotational speed sensor 21 that the engine rotational speed is in a predetermined idling rotational speed region, it is determined that the solenoid valve is in the feedback mode, and the program advances to Step S3. In any other case, the program advances to Step S2.

Step S2 . . . as a feedback control term Ifb(n), a preceding determined value Ixref which has been stored in the memory 2 at Step S6 is adopted. When there is no determined value Ixref stored in the memory 2, a value likely to the determined value, which has been stored in memory 2 in advance, is read out as a determined value Ixref. The program then advances to Step S7 described below.

Figure 3:
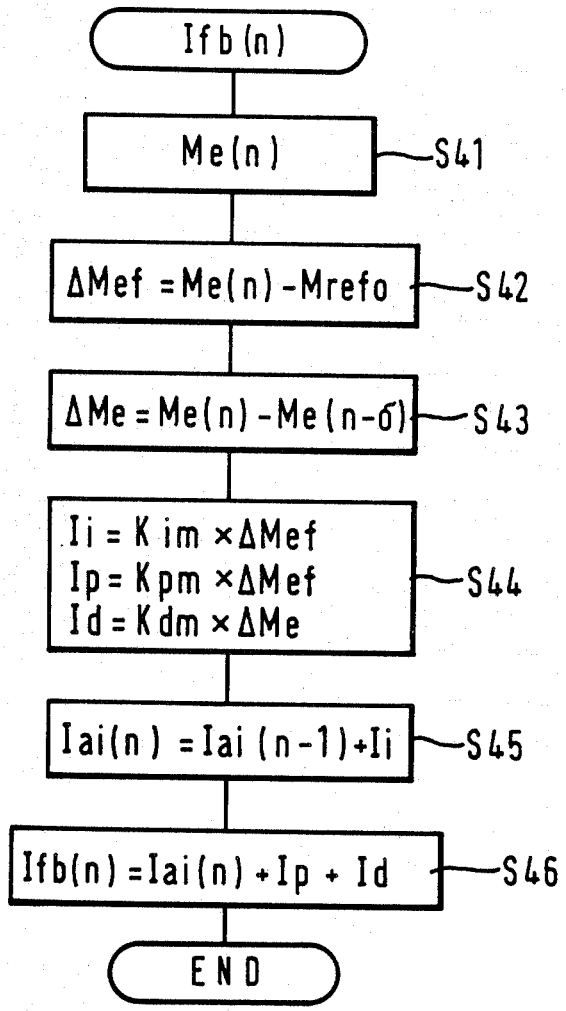
FIG. 3 is a flow chart for calculating a feedback control term Ifb(n).

Step S3 . . . Ifb(n) is calculated by calculation for the engine rotational speed feedback control mode in such a manner as described above in connection with FIG. 3.

Step S4 . . . it is determined whether or not the predetermined requirements for allowing appropriate calculation of the determined value Ixref(n) at Step S5 described below, are met. Particularly, it is determined whether or not the predetermined requirements are met in that the car speed is lower than a predetermined level V1 and that there are no external loads such as an air conditioner and power steering. When the determination is negative, the program advances to Step S7, and when it is affirmative, the program advances to Step S5. It is to be noted that while it is necessary to provide various sensors which develop outputs applied to the interface 3 in order to determine the requirements as described above, this is well known in the art and hence such sensors are not shown in FIG. 4.

Step S5 . . . a determined value Ixref(n) is calculated using equation (2) described above.

Step S6 . . . the determined value calculated at Step S5 is stored in the memory 2.

Step S7 . . . values of the individual correction terms of equation (1) or (3), that is, the addition correction terms Ie, Ips, Iat and Iac and the multiplication correction term Kpad, are read in. In order to read in the various values, it is necessary to provide sensors which provide sensor outputs to the interface 3, similarily to Step S4. However, because this is also well known in the art, such sensors are not shown in FIG. 4.

Step S8 . . . a solenoid current control value Icmd is calculated by equation (1) above. Where Step S2 has been passed through, the value Icmd is calculated by equation (3).

In the present invention, the addition and multiplication correction terms may not necessarily be limited to those appearing in equation (1) or (3), and other correction terms may be added. However, it is naturally necessary to read in values for such additional correction terms in advance at Step S7 above.

Figure 5:
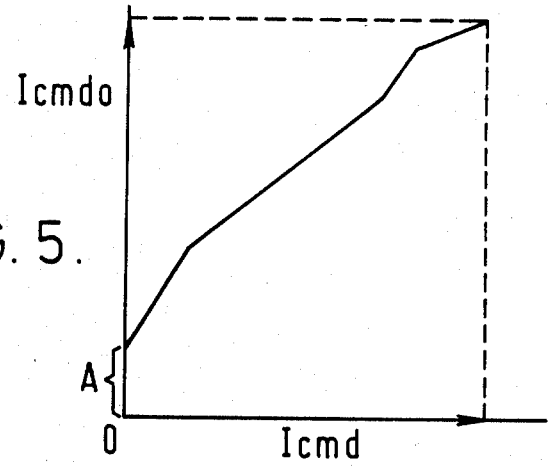
FIG. 5 is a diagram showing a relationship between a solenoid current control value Icmd and a corrected current control value Icmdo.

Step S9 . . . an Icmd - Icmdo table, which has been stored in advance in the memory 2, is read out in response to the solenoid current control value Icmd to determine a corrected current control value Icmdo. FIG. 5 is a diagram showing an example of the relationship between the solenoid current control value Icmd and the corrected current control value Icmdo.

The provision of the Icmd - Icmdo table is necessary for the following reason. Icmd is a value which is determined, in the feedback mode, from the engine rotational speed feedback control term Ifb(n) and the other correction terms as is apparent from equation (1) and is a theoretical value for controlling the opening of a solenoid valve within a range from 0% to 100% in order to bring the engine rotational speed close to an aimed idling rotational speed. However, the opening characteristic of a solenoid valve does not exhibit a linear proportional relationship with respect to the electric current fed thereto. Therefore, it is necessary to corrected Icmd taking the characteristics of the solenoid valve into consideration in order that the opening of the actual solenoid valve may be controlled in a linear manner from 0% to 100%. This is the reason why the Icmd - Icmdo table is provided.

Step S10 . . . the corrected current control value Icmdo determined at Step S9 above is stored in the memory 2.

Step S11 . . . an actual current value Iact supplied from the current detecting circuit 10 is read in.

Step S13 . . . an integration term Di(n) for current feedback control is calculated in accordance with the equation indicated in block Sl3 using a preceding time corrected current control value Icmdo(n−1) which has been stored at Step S9 above, the present actual current value Iact read in at Step S11 above, an integration term control gain Kii which has been stored in advance in the memory 2, and a preceding time integration term Di(n−1). Where there is no Di(n−1) stored in the memory 2, a preceding determined value Dxref which has been stored in the memory 2 at Step S22 described below is used as Di(n−1). (This value is stored in a backup RAM within memory 2 which is powered by an independent power supply). Such a condition occurs when the ignition switch is turned on to start the engine and current feedback control first begins, that is, at a first processing of Step S13.

Similarily, since Icmdo(n−1) is not yet stored at Step S10 above, immediately after the ignition switch has been turned on, a value of Icmdo corresponding to Icmd=0 of FIG. 5 is used as Icmdo(n−1).

Step S15 . . . Di(n) calculated at Step S13 is stored in the memory 2.

Step S17 . . . a present time actual current value Iact(n) is compared with the preceding time corrected current control value Icmdo(n−1) stored in the memory 2 at Step S10 in order to determine whether or not it is smaller than Iact(n). When the determination is affirmative, that is, when the actual current value Iact(n) is smaller than the value Icmdo(n−1), the program advances to Step S18, but when the determination is negative, the program advances to Step S19.

Step S18 . . . "1" is set as a present time flag Fi(n). The flag is temporarily stored in the memory 2 so that it can be used as a flag Fi(n−1) in the next cycle. The program then goes to Step S20.

Step S19 . . . "0" is set as a present time flag Fi(n). The flag is temporarily stored in the memory 2 so that it can be used as a flag Fi(n−1) in the next cycle.

Step S20 . . . if the present time flag Fi(n) is equal to the preceding flag Fi(n−1), Step S21 and Step S22 are bypassed and the program advances to Step S24. When the flags are not equal to each other, or in other words, when the present time actual current value Iact(n) crosses the preceding corrected current control value Icmdo(n−1), an appropriate determined value Dxref(n) for current feedback control can be obtained, and the program advances to Step S21.

Step S21 . . . a determined value Dxref(n) as defined by equation (4) below is calculated.

$$Dxref(n)=Di(n)\times Ccrr/m+Dxref(n-1)\times(m-Ccrr)/m \quad (4)$$

Di(n) in equation (4) is a value calculated at Step S13 above and stored in the present time value memory while Dxref(n−1) indicates a preceding time value of the determined value Dxref. Further, m and Ccrr are predetermined positive numbers, and m is selected greater than Ccrr.

Step S22 . . . the present determined value Dxref calculated at Step S21 is stored in the memory 2.

Step S24 . . . a feedback control term Dfb(n) is calculated by equation (5A) below using the preceding corrected current control value Icmdo(n−1) stored at Step S10 above, the present time actual current value Iact(n) read in at Step S11 above, a proportion term control gain Kip which has been stored in advance in the memory 2, and the integration term Di(n) stored in the present time value memory.

$$Dfb(n)=Dp(n)+Di(n) \quad (5A)$$

$$Dp(n)=Kip[Icmdo(n-1)-Iact(n)] \quad (5B)$$

$$Di(n)=Di(n-1)+Kii[Icmdo(n-1)-Iact(n)] \quad (5C)$$

Calculations of current deviations of the integration term Di(n) and the proportion term Dp(n) of equations (5C) and (5B) are effected based on the preceding corrected current control value Icmdo(n−1) and the present time actual current value Iact(n). This is because even if the corrected current control value Icmdo changes, the actual current value Iact does not immediately show a change due to the inductance of the solenoid and it takes a period of time for the actual current Iact to become stabilized after a change in Icmdo. Hence, calculations of the integration term Di(n) and the proportion term Dp(n) based on deviations of the present time values of the corrected current control value Icmdo and the actual current value Iact will cause errors in the individual terms, resulting in an error in the calculation of an appropriate feedback control term Dfb(n). Further, an appropriate determined Dxref at Step S21 above will not be assured.

The integration term Di(n) and the proportion term Dp(n) at Step S24 are not electric current values but values, for example, converted into high level pulse durations (hereinafter referred to as pulse durations) of pulse signals having a fixed period. This is because the specified terms obtained as electric current values are converted into pulse durations using a known table of electric current value I - pulse duration D. Accordingly, the feedback control term Dfb(n) is also obtained as a pulse duration. In addition, the determined value Dxref(n) of the integration term Di(n) obtained at Step S21 above is also set as a pulse duration.

Step S26 . . . limit checking of Dfb(n) is effected in a manner as hereinafter described with reference to FIG. 8.

Step S27 . . . the voltage VB of the battery 6 is read by a sensor (not shown).

Figure 6:
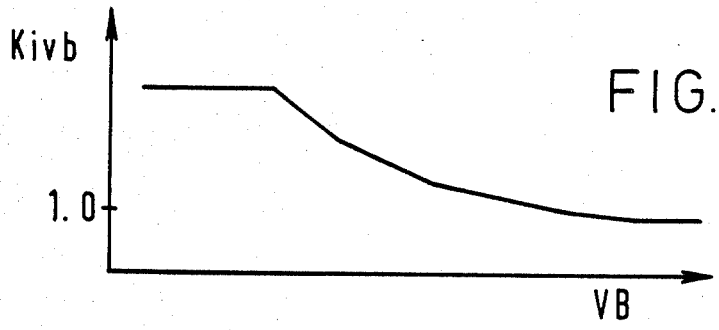
FIG. 6 is a diagram showing a relationship between a battery voltage VB and a battery voltage correction value Kivb.

Step S28 . . . a VB - Kivb table, which has been stored in advance in the memory 2, is read out to determine a battery voltage correction value Kivb based upon the battery voltage VB. FIG. 6 is a diagram showing the relationship between the battery voltage VB and the battery voltage correction value Kivb. As is apparent from the diagram, the battery voltage correction value Kivb is "1.0" when the battery voltage VB is higher than a predetermined voltage (for example, higher than 12 V), but if VB falls, the value will become correspondingly higher than 1.0 to maintain constant current.

Figure 7:
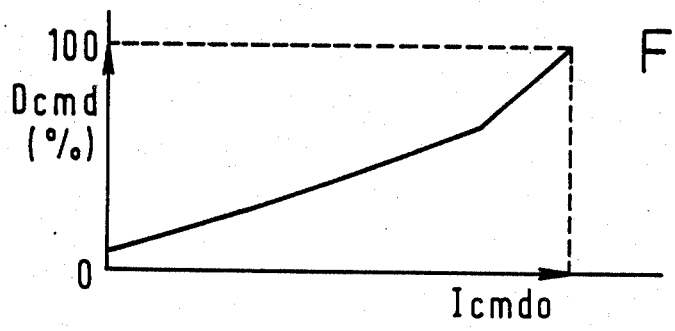
FIG. 7 is a diagram showing a relationship between the corrected current control value Icmdo and a pulse duration Dcmd.

Step S29 . . . an Icmdo - Dcmd table, which has been stored in advance in the memory 2, is read out to determine a pulse duration Dcmd(n) from the corrected current control value Icmdo(n) stored at Step S10 above. FIG. 7 is a diagram showing the relationship between the corrected current control value Icmdo and the pulse duration Dcmd.

If the pulse duration Dout(n) of a pulse signal which is generated and is output from the microprocessor 4, varies, then the solenoid current varies relative to the corrected current control value Icmdo, that is, a deviation of the solenoid current occurs, and hence, the amount of actually sucked air varies and an error will appear. The table described above defines the relationship between Icmdo and Dcmd in such a manner as to eliminate such an error.

Step S30 . . . a pulse duration Dout(n) of a pulse signal, which is a final output of the microprocessor 4, is calculated by equation (6) below using Dcmd(n) determined at Step S29 above, Dfb(n) calculated at Step S24 and checked for limits at Step S26, and the battery voltage correction value Kivb determined at Step S28.

$$Dout(n)=Kivb\times[Dcmd(n)+Dfb(n)] \quad (6)$$

Thus, Dout(n) is determined by adding Dfb(n) of the current feedback control system which is determined based on a deviation of the present time actual current value Iact(n) from the preceding corrected current control value Icmdo(n−1) to Dcmd(n) which is determined based on the corrected current control value Icmdo for the engine rotational frequency feedback control system to determine a pulse duration and by multiplying the pulse duration thus calculated by the battery voltage correction value Kivb.

Step S31 . . . limit checking is effected in a manner hereinafter described with reference to FIG. 9. After this, the process returns to the main program. Thus, the microprocessor 4 successively develops pulse signals having the pulse duration Dout(n).

Figure 8:
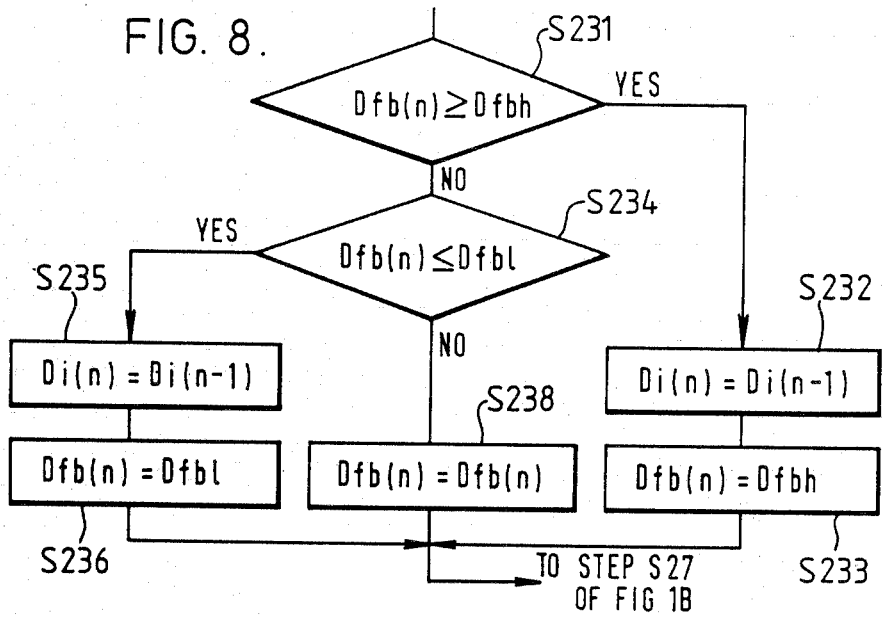
FIG. 8 is a flow chart illustrating contents of calculations at Step S26 of FIG. 1B.

FIG. 8 is a flow chart illustrating the contents of the calculation at Step S26 of FIG. 1.

Step S231 . . . it is determined whether of not Dfb(n) calculated at Step S24 of FIG. 1 is greater than a certain upper limit Dfbh. When the determination is negative, the program advances to Step S234, and when the determination is affirmative, the program advances to Step S232.

Step S232 . . . the preceding integration value Di(n−1), which is stored in the memory 2, is stored as the present integration value Di(n).

Step S233 . . . Dfb(n) is set to its upper limit, that is, Dfbh. The program then advances to Step S27 of FIG. 1.

Step S234 . . . it is determined whether or not Dfb(n) is smaller than a certain lower limit Dfbl. When the determination is negative, Dfb(n) is considered to be within an appropriate range defined by the limits, and the program advances to Step S238. However, when the determination is affirmative, the program goes to Step S235.

Step S235 . . . the preceding integration value Di(n−1) is stored in the present time value memory in a similar manner as at Step S232 above.

When Dfb(n) is determined to be out of the range defined by the upper and lower limits as a result of the processing at Step S232 and Step S235 above, the integration term will not be updated by the next time calculation at Step S13 (FIG. 1). If the integration term is otherwise updated while Dfb(n) is out of the range, the value of the integration term will be extraordinary so that when a normal condition in which Dfb(n) is within the range is restored, an appropriate feedback control term Dfb(n) will not be obtained smoothly. Thus, the elimination of updating of the integration term is intended to eliminate such a condition.

Step S236 Dfb(n) is set to its lower limit value, that is, Dfbl. After this, the program advances to Step S27 of FIG. 1.

Step S238 . . . Dfb(n) is set to the value calculated at Step S24 of FIG. 1. After this, the program advances to Step S27 of FIG. 1.

Figure 9:
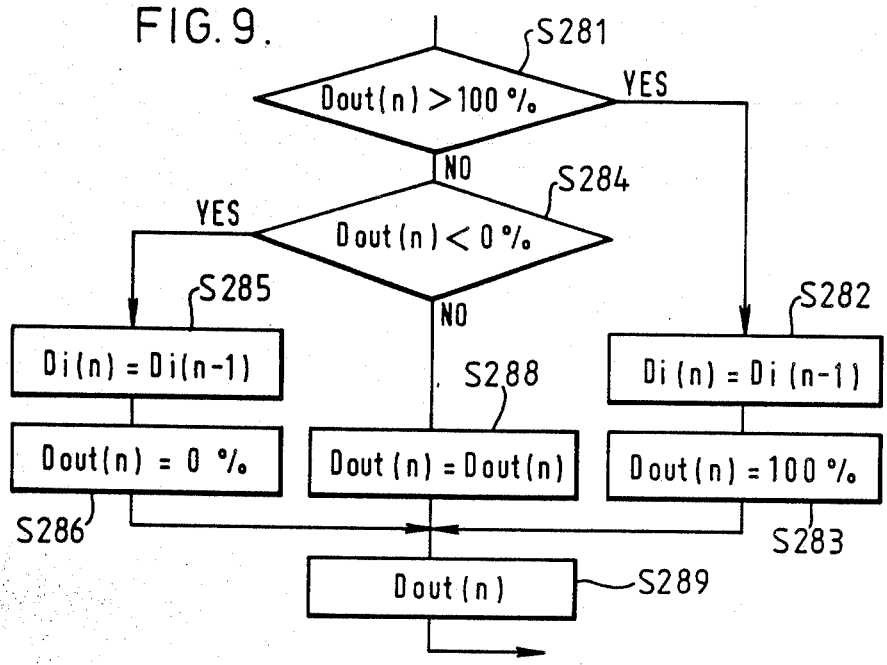
FIG. 9 is a flow chart illustrating contents of calculations at Step S31 of FIG. 1B.

FIG. 9 is a flow chart illustrating contents of calculations at Step S31 of FIG. 1.

Step S281 . . . it is determined whether or not Dout(n), calculated at Step S30 of FIG. 1, is greater than the 100% duty ratio of the output pulse signals of the microprocessor 4. When the determination is negative, the program advances to Step S284, and when the determination is affirmative, the program advances to Step S282.

Step S282 . . . the preceding integration value Di(n−1) which is stored in the preceding time value memory is stored in the memory 2 as the present integration value Di(n).

Step S283 . . . Dout(n) is set to the 100% duty ratio of the output pulse signals. The reason why Dout(n) is limited to the 100% duty ratio of the output pulse signals is that even if the solenoid current is controlled based on Dout(n) which is greater than the 100% duty ratio, a solenoid current actually corresponding thereto can not be obtained.

Step S284 . . . it is determined whether or not Dout(n) is smaller than the 0% duty ratio of the output pulse signals of the microprocessor 4. When the determination is negative, Dout(n) is considered to be within an appropriate range defined by the limit, and the program advances to Step S288. However, when the determination is affirmative, the program advances to Step S285.

Step S285 . . . the preceding integration value Di(n−1) is stored in the present time value memory in a similar manner as in Step S282 above.

When Dout(n) is out of the range defined by the upper and lower limits as a result of the processings of Step S282 and Step S285 above, the integration term will not be updated by the next time calculation at Step S13 (FIG. 1). The reason why the integration term is not updated in this manner is similar to that described above in connection with Step S235.

Step S286 . . . Dout(n) is set to the 0% duty ratio of the output pulse signals. The reason why Dout(n) is limited to the 0% duty ratio of the output pulse signals is that even if the solenoid current is controlled based on Dout(n) which is smaller than the 0% duty ratio, a solenoid current actually corresponding thereto can not be obtained.

Step S288 . . . Dout(n) is set to the value calculated at Step S30 of FIG. 1.

Step S289 . . . Dout(n) is output. In response to this, the microprocessor 4 successively develops pulse signals of a duty ratio corresponding to Dout(n) which are applied to the solenoid driving transistor 5.

Figure 10:
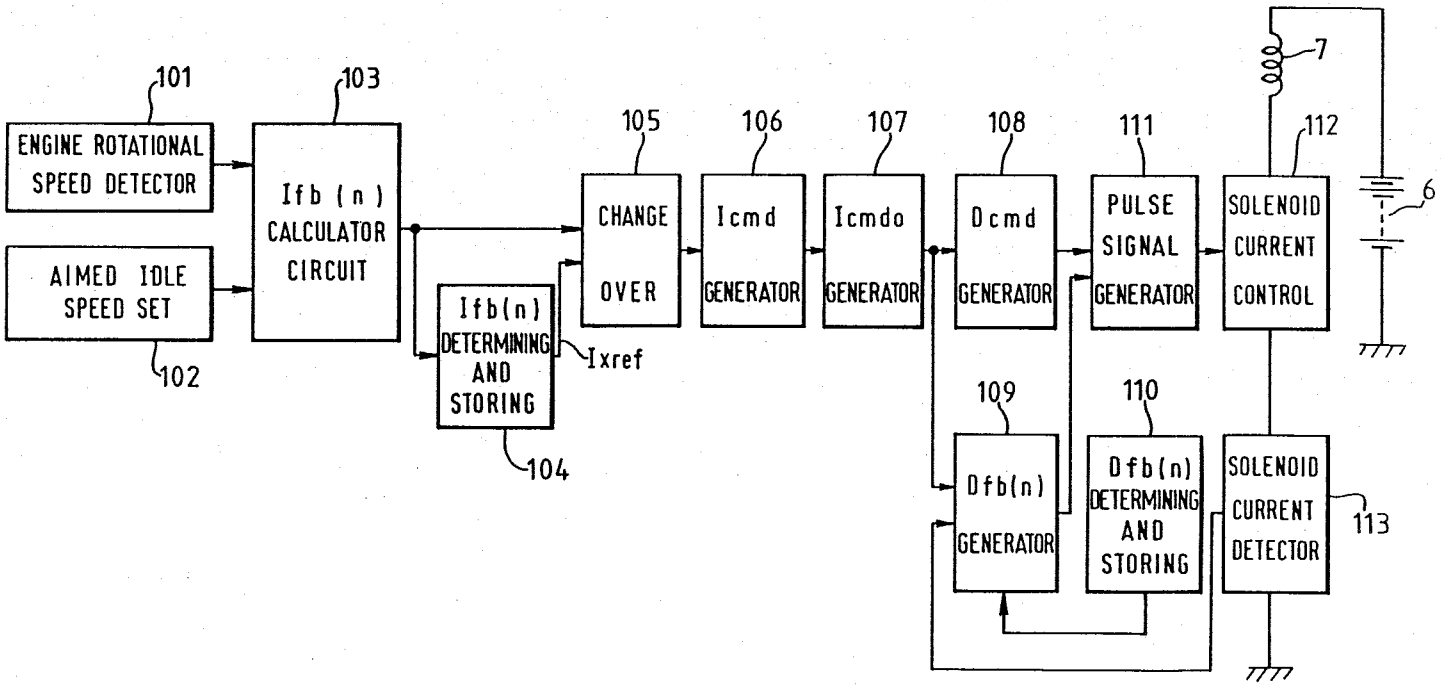
FIG. 10 is a block diagram of a solenoid current controlling device of the present invention.
Figure 11:
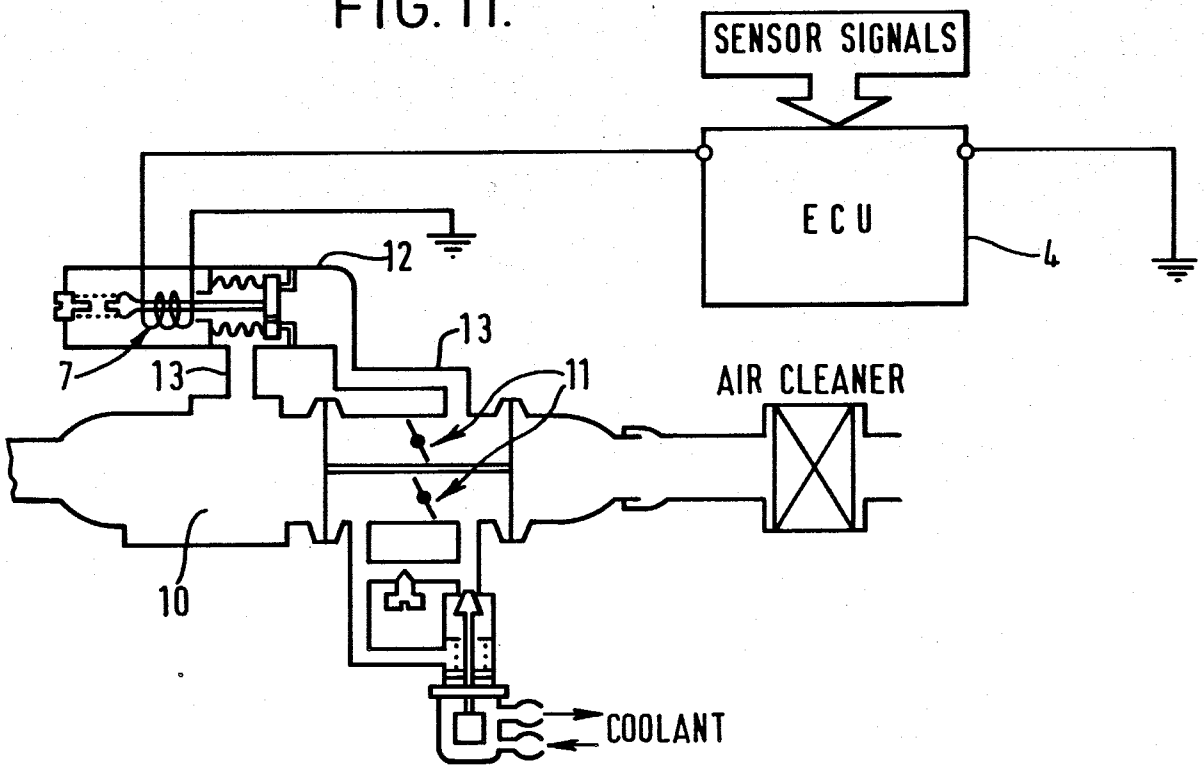
FIG. 11 is a schematic illustration of the throttle valve and solenoid valve in combination with an engine.

FIG. 10 is a block diagram illustrating the general functions of a solenoid current controlling device to which the present invention using the flow chart of FIGS. 1A and 1B is applied. Referring to FIG. 10, an engine rotational speed detecting means 101 detects the actual rotational speed of an engine and outputs Me(n), a reciprocal number of the engine rotational speed. An aimed idling rotational speed setting means 102 determines an aimed idling rotational speed Nrefo in accordance with the running conditions of the engine and develops a reciprocal number or value Mrefo.

An Ifb(n) calculating means 103 calculates a feedback control term Ifb(n) from Me(n) and Mrefo and outputs it to a change-over means 105 and an Ifb(n) determining and storing means 104. The Ifb(n) determining and storing means 104 determines an integration term Iai(n) of the feedback control term Ifb(n) in accordance with equation (2) above and outputs a latest determined value Ixref.

The change-over means 105 supplies Ifb(n) output from the Ifb(n) calculating means 103 to an Icmd generating means 106 when a solenoid valve (not shown), the opening of which is proportionally controlled in response to an electric current flowing through a solenoid 7, is in the engine rotational speed feedback control mode. On the other hand, when the solenoid valve is in the open loop control mode, the change-over means 105 delivers the latest determined value Ixref output from the Ifb(n) determining and storing means 104 to the Icmd generating means 106.

The Icmd generating means 106 calculates a solenoid current control value Icmd, for example, in accordance with equation (1) above when Ifb(n) is received. However, when Ixref is received, the Icmd generating means 106 calculates a solenoid current control value Icmd, for example, in accordance with equation (3) above.

While not shown in the drawings, the correction terms of the equations (1) and (3) are supplied to the Icmd generating means 106. This Icmd is supplied to an Icmdo generating means 107.

The Icmdo generating means 107 reads out, in response to Icmd supplied thereto, an Icmd - Icmdo table which has been stored in advance and determines and outputs a corrected current control value Icmdo. This Icmdo is supplied to a Dcmd generating means 108 and a Dfb(n) generating means 109.

The Dcmd generating means 108 reads out, in response to Icmdo supplied thereto, an Icmdo - Dcmd table which has been stored in advance and determines a pulse duration Dcmd corresponding to the Icmdo and supplied it to a pulse signal generating means 111.

The Dfb(n) generating means 109 calculates a feedback control term Dfb(n) by equation (5A) from the Icmdo and an actual current value Iact which is an output of a solenoid current detecting means 113 which detects the electric current flowing through the solenoid 7 in response to on/off driving of a solenoid current controlling means 112 which will be hereinafter described. The Dfb(n) generating means 109 supplies Dfb(n) thus calculated to a Dfb(n) determining and storing means 110 and the pulse signal generating means 111.

When no preceding integration value Di(n−1) in equation (5A) has been calculated, a latest determined value Dxref which is obtained by the Dfb(n) determining and storing means 110 is used as Di(n−1). The Dfb(n) determining and storing means 110 determines an integration term Di(n) of the feedback control term Dfb(n) in accordance with equation (4) above and outputs a latest determined value Dxref.

The pulse signal generating means 111 corrects the pulse duration Dcmd supplied thereto in accordance with Dfb(n) and outputs a pulse signal having a corrected pulse duration Dout. The solenoid current controlling means 112 is driven on and off in response to the pulse signal supplied thereto. As a result, the electric current from battery 6 flows through the solenoid 7, the solenoid current controlling means 112 and the solenoid current detecting means 113 to ground.

The foregoing description relates to a case where determining Dfb(n) is effected independently of the temperature of the solenoid to obtain a determined value Dxref, however, according to the present invention, such determining may be otherwise effected for each temperature range of a solenoid (for example, each temperature range of engine cooling water), and for example, one of the determined values which is nearest to the temperature of the solenoid may then be used as an initial value for the corrected value, upon starting of the solenoid current control. Thus, an initial value for the corrected value upon starting of solenoid current control can be determined based on a more appropriate determined value.

As is apparent from the foregoing description, according to the present invention, the following effects can be attained.

(1) A pulse duration Dout(n) of output pulse signals of a microprocessor are determined from Dcmd(n) which is determined by an engine rotational speed feedback control system and Dfb(n) determined by a current feedback control system so that, even where a solenoid current control is used which attempts to provide a solenoid current corresponding to Dcmd(n), under control of the current feedback control system even if such a condition where a solenoid current corresponding to Dcmd(n) does not flow, the solenoid current will be approximated to a value corresponding to Dcmd(n) from the time of starting of the engine since a determined value Dxref of Dfb(n) is used as the initial value of the preceding integration value for the integration term of Dfb(n).

As a result, the time period before the solenoid current reaches a value corresponding to Dcmd(n) is shortened, and hence the engine rotational speed will rise rapidly to a predetermined rotational speed corresponding to Dcmd(n).

(2) Further, while individual solenoid valves have somewhat different characteristics and hence different time periods before the solenoid current reaches a value corresponding to Dcmd(n), there will be differences in the time period before the engine rotational speed rises to a predetermined rotational speed corresponding to Dcmd(n). Because the time period before the solenoid current reaches a value corresponding to Dcmd(n) is shortened as described above, the differences will be so small that they can be ignored from a practical point of view.

Figure 12:
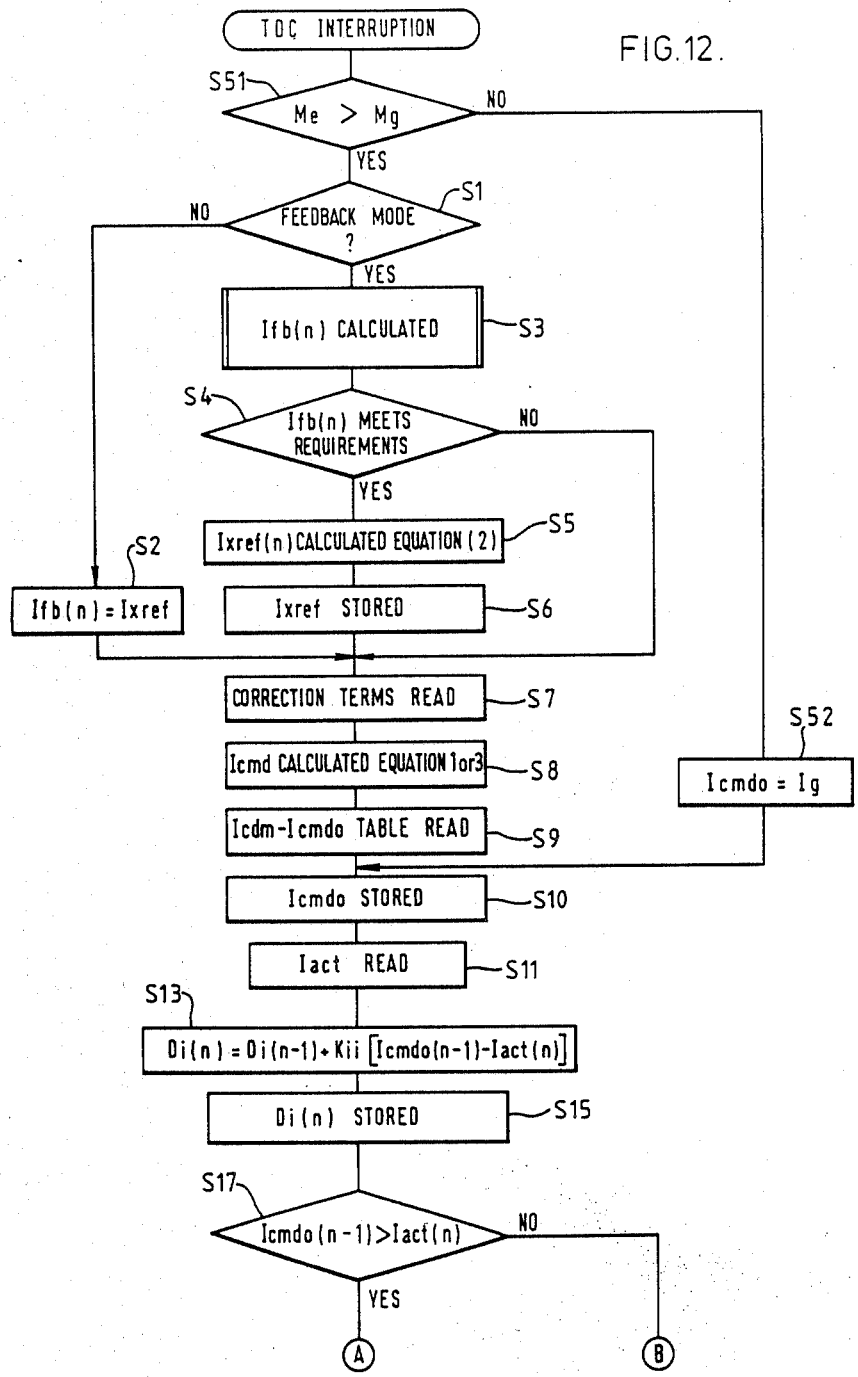
FIG. 12 is a modification of the flow chart of FIG. 1A illustrating another aspect of the present invention.

A further feature of the present invention is shown in FIG. 12. The flow chart in FIG. 12 is the same as that in FIG. 1A with the addition of Steps S51 and S52.

Step S51 . . . it is determined whether or not a number Me, which is the reciprocal of the engine rotational speed, is greater than a preset value Mg. In other words, it is determined whether or not the car is running at a speed higher than a predetermined speed and the engine rotational speed is lower than a predetermined engine rotational speed (for example, 4000 RPM) by which it can be determined that the car is in a running condition in which the amount of fuel mixture fed into a cylinder of the engine is controlled only by the throttle valve which is controlled by the operation of the accelerator.

If Me is greater than Mg (that is, if the engine rotational speed is lower than 4000 RPM), then the program advances to Step S1. However, when Me is equal to or smaller than Mg, the program advances to Step S52.

Step S52 . . . Ig is set as a corrected current control value Icmdo. Ig is a value corresponding to a non-operating current which falls short of the operation starting current for the solenoid and is determined such that Dout(n), which is calculated at Step S30, is a value corresponding to Ig when the program advances by way of Step S52.

Referring to Steps S9 and S10 in FIG. 12, and FIG. 5, the region indicated by the symbol A represents the control value Icmdo corresponding to the non-operating current of the solenoid and Ig is a value within the region A.

As is apparent from Step S51 or S52, even if the engine rotational speed exceeds the predetermined level (4000 RPM) and hence the output of the engine rotational speed feedback control system, that is, the solenoid current control value Icmd, becomes zero, the solenoid is energized by its non-operating current and thus the current feedback control term Dfb(n) is calculated.

In particular, in the flow chart of FIG. 12, when Me is greater than Mg, Dfb(n) of the current feedback control system which is determined in accordance with the deviation of the present actual current Iact(n) from the preceding corrected current control value Icmdo(n−1), is added to Dcmd(n) which is determined in accordance with the corrected current control value Icmdo of the engine rotational speed feedback control system. This determines a pulse duration which is then multiplied by the battery voltage correction value Kivb to calculate Dout(n). In other words, feedback control of the solenoid current is accomplished by approximating the solenoid current to the corrected current instruction value Icmdo.

Meanwhile, when Me is equal to or smaller than Mg, the output Icmd of the engine rotational speed feedback control system is not calculated, or in other words, the solenoid valve in the by-pass path does not operate, but Icmdo is set to the control value Ig corresponding to a non-operating current of the solenoid. After this, similarily to the situation wherein Me is greater than Mg, Dout(n) is calculated and feedback control of the solenoid current is accomplished.

Figure 13:
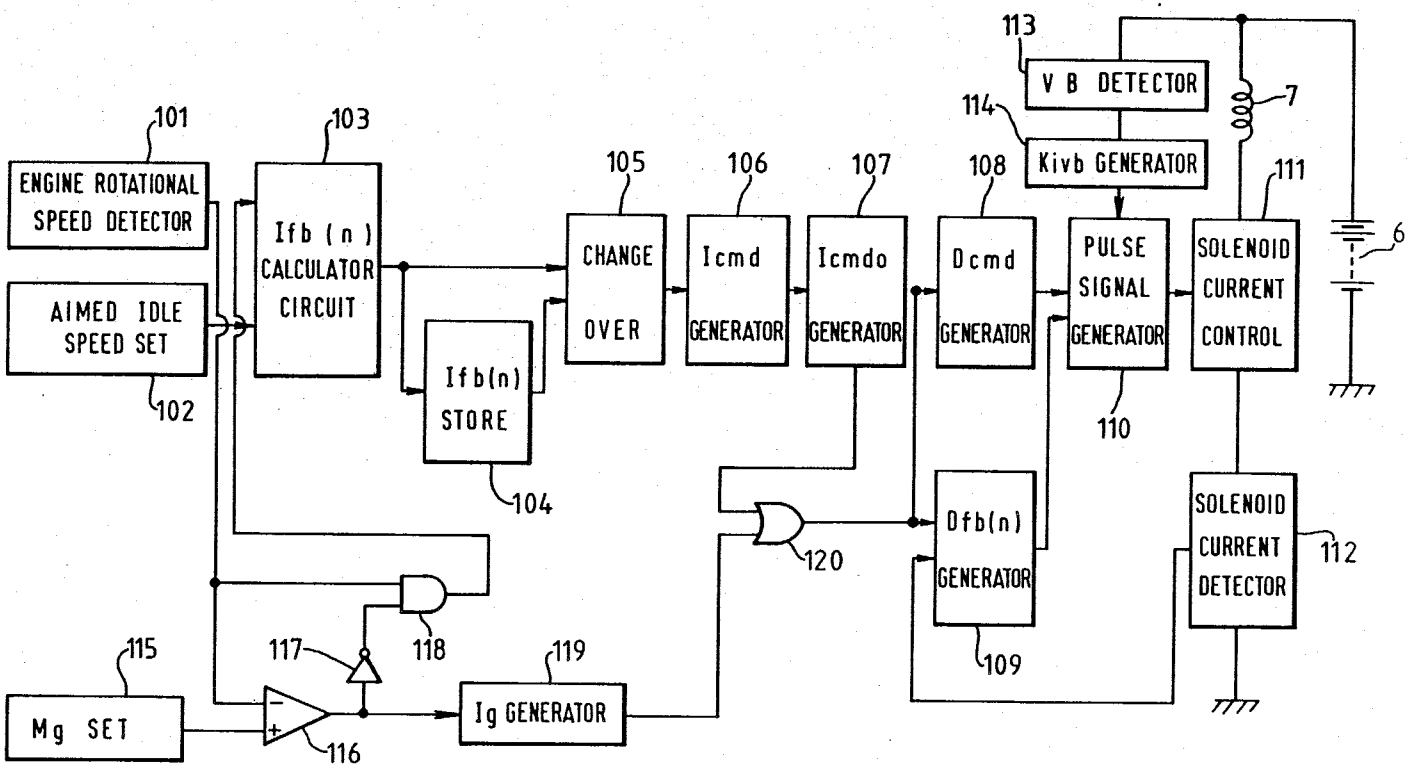
FIG. 13 is a block diagram of a solenoid current control device incorporating a further feature of the present invention.

FIG. 13 is a block diagram illustrating the general functions of a solenoid current controlling device for realizing the present invention using the flow chart of FIGS. 12 and 1B.

Referring to FIG. 13, an engine rotational speed and period detecting means 101 provides an output corresponding to the reciprocal of the engine rotational speed which is a value Me(n) to an inverted input terminal of a comparator 116 and also to an input terminal of a gate 118.

An aimed idling rotational speed setting means 102 determines an aimed idling rotational speed Nrefo in accordance with the running conditions of the engine and develops an output corresponding to the reciprocal or a corresponding value Mrefo to Ifb(n) calculating means 103.

An Mg setting means 115 has a value of Mg stored therein which has been described hereinabove in connection with Step S51 of FIG. 12. The value Mg is applied to a non-inverted input terminal of a comparator 116. The comparator 116 provides an output signal to an inverter 117 and to an Ig generating means 119 when Mg is greater than Me, or in other words, when the engine rotational speed is greater than 1/Mg.

An output terminal of the inverter 117 is connected to a control terminal of the gate 118. The gate 118 outputs, upon receiving an output signal of the inverter 117, Me, a reciprocal of the engine rotational speed, which is calculated by the engine rotational speed and period detecting means 101 and applies it to the Ifb(n) calculating means 103.

The Ig generating means 119 has a value of Ig stored therein which has been described hereinabove in connection with Step S52 of FIG. 12. The Ig generating means 119 receives an output signal from comparator 116 and applies the value of Ig to one of input terminals of an OR circuit 120.

The Ifb(n) calculating means 103 calculates a feedback control term Ifb(n) from Me(n) and Mrefo and outputs it to a change-over means 105 and an Ifb(n) determining and storing means 104. The Ifb(n) determining and storing means 104 determines an integration term Iai(n) of the feedback control term Ifb(n) in accordance with equation (2) above and outputs a latest determined value Ixref.

The change-over means 105 supplies Ifb(n) from the Ifb(n) calculating means 103 to an Icmd generating means 106 when a solenoid valve, the opening of which is proportionally controlled in response to an electric current flowing through a solenoid 7, is in the feedback control mode. When the solenoid valve is in the open loop control mode, the change-over means 105 delivers the latest determined value Ixref from the Ifb(n) determining and storing means 104 to the Icmd generating means 106.

The Icmd generating means 106 calculates a solenoid current control value Icmd, for example, in accordance with equation (1) above when Ifb(n) is applied thereto. However, when Ixref is applied thereto, the Icmd generating means 106 calculates a solenoid current instruction value Icmd for example in accordance with equation (3) above. This Icmd is applied to an Icmdo generating means 107. While not shown in the drawings, the correction terms of equations (1) and (3) are applied to the Icmd generating means 106.

The Icmdo generating means 107 reads out, in response to the Icmd applied thereto, an Icmd - Icmdo table which has been stored in advance and determines an output which is a corrected current control value Icmdo. Icmdo is supplied to the other input terminal of the OR circuit 120.

The OR circuit 120 supplies Icmdo determined by the Icmdo generating means 107 or Ig determined by the Ig generating means 119 to the Dcmd generating means 108 and the Dfb(n) generating means 109. The Dcmd generating means 108 reads out, in response to Icmdo supplied thereto, an Icmdo - Dcmd table which has been stored in advance and determines a pulse duration Dcmd corresponding to Icmdo and supplies it to a pulse signal generating means 110.

The Dfb(n) generating means 109 calculates a feedback control term Dfb(n) from Icmdo and an actual current value Iact which is an output of a solenoid current detecting means 112 which detects the current flowing through the solenoid 7 in response to on/off driving of a solenoid current controlling means 111 which will be hereinafter described. The Dfb(n) generating means 109 supplies Dfb(n) thus calculated to the pulse signal generating means 110.

A Kivb generating means 114 reads out a VB - Kivb table which has been stored therein in advance in response to a battery voltage VB detected by a VB detecting means 113 to determine a battery voltage correction value Kivb which is delivered to the pulse signal generating means 110.

The pulse signal generating means 110 corrects the pulse duration Dcmd supplied thereto in accordance with Dfb(n) and Kivb and outputs a pulse signal having a corrected pulse duration Dout. The solenoid current controlling means 111 is driven on and off in response to the pulse signal supplied thereto. As a result, current from battery 6 flows through the solenoid 7, the solenoid current controlling means 111 and the solenoid current detecting means 112 to ground.

As can be seen from the functional block diagram shown in FIG. 13, when it is not determined at comparator 116 that Me is greater than Mg, that is, when the solenoid valve is not under idling feedback control or is under open loop control regarding engine rotational speed, Ig is set as Icmdo so that a non-operating current for the solenoid 7 is supplied to the solenoid 7 to thus effect current feedback control.

As is apparent from the foregoing description of this aspect of the present invention, the following effects can be attained. In particular, even in a running condition when opening control of a solenoid valve located in a by-pass path, is not effected and thus the opening of the solenoid valve is held to zero, a non-operating current for the solenoid valve is supplied to the solenoid valve, and a pulse duration Dout(n) of an output pulse signal of a microprocessor corresponding to the non-operating current is determined in accordance with Dcmd(n) corresponding to the non-operating current and Dfb(n) determined by a current feedback control system. Consequently, (1) In such a running condition, even if, for example, the resistance of the solenoid changes and thereafter control of the magnet valve is switched back to the feedback control mode, control of the solenoid valve can be initiated with an actual required solenoid valve opening. As a result, the engine rotational speed can rapidly be brought close to an aimed idling rotational speed.

(2) In such a running condition, even if, for example, the resistance of a solenoid changes and thereafter control of the solenoid valve is switched back to the open loop control mode regarding the engine rotational speed, control of the solenoid valve can be initiated with an actual required solenoid valve opening in a manner similar to that described in paragraph (1) just above.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. An apparatus for controlling the solenoid current of a solenoid valve which controls the amount of suction air in an internal combustion engine, said apparatus comprising:

(a) engine rotational speed detector means for detecting engine rotational speed;

(b) aimed idle speed setting means for generating a signal corresponding to a predetermined idling speed;

(c) first calculating means coupled to said engine rotational speed detector means and said aimed idle speed setting means for calculating a feedback control term Ifb(n) as a function of an integration term (Iai), a proportion term (Ip), and a differentiation term (Id);

(d) first determining and storing means coupled to said first calculating means, for determining an integration term (Iai(n)) of the feedback control term (Ifb(n)) and for determining a determined value (Ixref) in accordance therewith;

(e) changeover means coupled to said first calculating means and said first determining and storing means for selecting the output of one of said first calculating means or said first determining and storing means;

(f) first signal generating means coupled to said changeover means for generating a solenoid current control value (Icmd) as a function of the output of said changeover means;

(g) second signal generating means coupled to the output of said first signal generating means, for generating a corrected current control value (Icmdo) corresponding to the current control value;

(h) engine speed setting means for generating a signal corresponding to a predetermined engine speed;

(i) comparator means coupled to said engine rotational speed detector means and said speed setting means for determining if the engine speed is greater than the predetermined speed;

(j) means for generating a non-operating current control value coupled to said comparator means for generating a current control value (Ig) when the engine speed is greater than the predetermined speed;

(k) OR gate means having the inputs thereof connected to said second signal generating means and said means for generating a non-operating current control value;

(l) third signal generating means coupled to said OR gate means for generating a pulse duration signal (Dcmd) corresponding to the corrected current control value;

(m) solenoid current detector means, coupled to said solenoid valve, for detecting the current (Iact) flowing through the solenoid of said solenoid valve;

(n) fourth signal generating means coupled to the output of said second signal generating means and said solenoid current detector means for generating a feedback control term (Dfb(n)); and (o) pulse signal generating means coupled to said third signal generating means and said fourth signal generating means for generating a solenoid control pulse (Dout), wherein said solenoid control pulse is applied to said solenoid for energizing said solenoid.

2. An apparatus as set forth in claim 1, wherein said second signal generating means includes a current control value (Icmd) - corrected current control value (Icmdo) table.

3. An apparatus as set forth in claim 1, wherein said third signal generating means includes a corrected current control value (Icmdo) - pulse duration signal (Dcmd) table.

4. An apparatus as set forth in claim 1, further including means for detecting the voltage of a battery for said solenoid and for correcting the output of said pulse signal generating means as a function of the detected voltage.

* * * * *